US009534392B2

(12) United States Patent
Wey

(10) Patent No.: US 9,534,392 B2
(45) Date of Patent: Jan. 3, 2017

(54) TELESCOPING PIPE BOOT

(71) Applicant: LIBERTY DIVERSIFIED INTERNATIONAL, INC., New Hope, MN (US)

(72) Inventor: Scott Van Wey, Crystal, MN (US)

(73) Assignee: Liberty Diversified International, Inc., New Hope, MN (US)

( * ) Notice: Subject to any disclaimer, the term of this patent is extended or adjusted under 35 U.S.C. 154(b) by 0 days.

(21) Appl. No.: 14/626,347

(22) Filed: Feb. 19, 2015

(65) Prior Publication Data

US 2015/0240499 A1 Aug. 27, 2015

Related U.S. Application Data

(60) Provisional application No. 61/943,605, filed on Feb. 24, 2014.

(51) Int. Cl.
*E04D 13/147* (2006.01)

(52) U.S. Cl.
CPC ..... *E04D 13/1476* (2013.01)

(58) Field of Classification Search
CPC ..... E04D 13/1476
See application file for complete search history.

(56) References Cited

U.S. PATENT DOCUMENTS 198,350 A 12/1877 Chase
449,199 A * 3/1891 Boyd ..... E04D 13/1476 126/314
598,161 A 2/1898 Sahlstrom
1,279,572 A 9/1918 Moore
1,647,414 A 12/1925 Moore
1,750,019 A * 3/1930 Moore ..... E04D 13/1476 285/192
1,875,640 A 9/1932 Moore
2,113,872 A 4/1938 Brown
2,347,836 A 5/1944 Moore
2,427,413 A 9/1947 Miller
2,563,710 A 8/1951 Saul
2,805,616 A 9/1957 Patrick
2,806,419 A 9/1957 Artis
2,976,796 A 3/1961 Anthony
2,985,091 A 5/1961 Hatcher
3,313,559 A * 4/1967 Kifer ..... E04D 13/1476 285/136.1
3,345,932 A 10/1967 William
3,685,426 A 8/1972 Rosa
4,115,961 A * 9/1978 Bishop ..... E04D 13/14 285/42
4,442,643 A * 4/1984 Stadheim ..... E04F 17/04 285/44
4,482,267 A 11/1984 Widerby
(Continued)

FOREIGN PATENT DOCUMENTS

GB 1010301 11/1965
GB 1172457 12/1969

*Primary Examiner* — Rodney Mintz
(74) *Attorney, Agent, or Firm* — Barnes & Thornburg LLP

(57) ABSTRACT

A pipe boot assembly is provided that provides a base, first and second sleeves, and a cap. The first sleeve is attached to the base and the second sleeve is movable with respect to the first sleeve. The cap is attached to the second sleeve and has an opening disposed therein.

18 Claims, 11 Drawing Sheets

(56) References Cited

U.S. PATENT DOCUMENTS

| | | | | | |
|---|---|---|---|---|---|
| 4,563,847 | A * | 1/1986 | Hasty | E04D 13/1476 | 285/4 |
| 4,593,504 | A | 6/1986 | Bonnici | | |
| D308,572 | S | 6/1990 | Tietz | | |
| 4,955,167 | A * | 9/1990 | Holtgreve | F24F 7/02 | 454/275 |
| 5,245,804 | A * | 9/1993 | Schiedegger | E04D 13/1476 | 285/43 |
| 5,561,952 | A | 10/1996 | Damron | | |
| 5,588,267 | A * | 12/1996 | Rodriguez | E04D 13/1476 | 285/4 |
| 5,860,256 | A * | 1/1999 | Humber | E04D 13/1476 | 285/42 |
| 6,179,705 | B1 | 1/2001 | Genge | | |
| 6,244,006 | B1 | 6/2001 | Shue | | |
| 6,767,281 | B2 | 7/2004 | McKee | | |
| 6,792,977 | B2 | 9/2004 | Presby | | |
| D554,749 | S | 11/2007 | Ness | | |
| 7,549,258 | B2 | 6/2009 | Lajewski | | |
| D606,186 | S * | 12/2009 | Routh | D23/393 | |
| 7,798,891 | B2 | 9/2010 | Stubbert et al. | | |
| 7,980,035 | B1 * | 7/2011 | D'Apolito | E04B 1/7069 | 52/198 |
| 8,209,923 | B1 | 7/2012 | Rich | | |
| 8,298,053 | B2 | 10/2012 | Parry | | |
| 8,845,406 | B2 * | 9/2014 | McIver | F24F 7/02 | 454/367 |
| 8,984,822 | B1 * | 3/2015 | Cline | E04D 13/14 | 52/244 |
| 2003/0024185 | A1 * | 2/2003 | Menzies | E04D 13/14 | 52/219 |
| 2005/0055889 | A1 * | 3/2005 | Thaler | E04D 13/1476 | 52/58 |
| 2006/0211356 | A1 * | 9/2006 | Grassman | F23J 13/08 | 454/4 |
| 2008/0271391 | A1 * | 11/2008 | Dalmasso | F24F 7/02 | 52/199 |
| 2011/0302876 | A1 * | 12/2011 | Giffin | F24F 7/02 | 52/741.4 |

* cited by examiner

TELESCOPING PIPE BOOT

RELATED APPLICATIONS

The present application is related to and claims priority to U.S. Provisional Patent Application, Ser. No. 61/943,605, filed on Feb. 24, 2014, entitled "Pipe Boot." The subject matter disclosed in that provisional application is hereby expressly incorporated into the present application.

TECHNICAL FIELD AND SUMMARY

The present disclosure is related to a pipe boot that is postionable on a vent or plumbing pipe and is extendable upwardly from a roof.

In an illustrative embodiment, the present disclosure provides a pipe boot assembly that includes a base flashing, inner and outer sleeves, and a cap. The base flashing supports outer and inner sleeves placed over a PVC, plumbing, or like pipe extending from a roof of a building such as a house. The interlocking cap couples to the outer sleeve and the pipe to secure the assembly thereto.

Another illustrative embodiment of the present disclosure provides a pipe boot assembly comprising a base, first and second sleeves, and a cap. The base is configured to attach to a roof. The base is also configured to be located about a pipe that extends from the roof. The first sleeve is attached to the base and is configured to be located about the pipe. The second sleeve is movable with respect to the first sleeve and configured to be located about the pipe. The cap is attached to the second sleeve, and has an opening disposed therein configured to engage an end of the pipe. A periphery of the opening disposed in the cap includes a barb that couples the cap to the pipe.

In the above and other embodiments, the pipe boot assembly may further comprise: the first sleeve being an inner sleeve; the second sleeve is an outer sleeve; the first sleeve being located at least partially in the second sleeve; and wherein the second sleeve being movable in a telescoping manner with respect to the first sleeve; the base being a base flashing having at least one corner bent; the base, inner and outer sleeves each including an opening to receive the pipe; the barb having a tip configured to cut a groove into a sidewall of the pipe to secure the cap to the pipe; and the periphery of the opening disposed in the cap including a second barb spaced apart from the barb, and also coupling the cap to the pipe; wherein the second barb having a second tip configured to cut a groove into the sidewall of the pipe to secure the cap to the pipe.

Anther illustrative embodiment of the present disclosure provides a pipe boot assembly that also comprises a base, first and second sleeves, and a cap. The base is configured to attach to a roof. The base is configured to be located about a pipe that extends from the roof. The first sleeve is attached to the base and configured to be located about the pipe. The second sleeve is movable with respect to the first sleeve and is configured to be located about the pipe. The cap is attached to the second sleeve and has an opening disposed therein and a channel formed at a periphery of the opening. The channel is configured to receive an end of the pipe. The periphery of the opening includes a barb configured to form a groove in the pipe to secure the cap to the pipe.

In the above and other embodiments, the pipe boot assembly may further comprise: the barb being configured to form the grove in the pipe by rotational movement of the cap with respect to the pipe; the barb having a tip configured to form the groove into a sidewall of the pipe to secure the cap to the pipe; the periphery of the opening including a second barb spaced apart from the barb, and also coupling the cap to the pipe; wherein the second barb has a second tip configured to form a groove into the sidewall of the pipe to secure the cap to the pipe; both the barb and the second barb are directed toward the channel; the first sleeve being an inner sleeve; the second sleeve being an outer sleeve; the first sleeve being located at least partially in the second sleeve; and wherein the second sleeve being movable in a telescoping manner with respect to the first sleeve; the base being a base flashing having at least one bent corner; and the base, inner and outer sleeves each including an opening to receive the pipe.

Anther illustrative embodiment of the present disclosure provides a pipe boot assembly that also comprises a base, inner and outer sleeves, and a cap. The base is configured to attach to a roof. The base is configured to be located about a pipe that extends from the roof. The inner and outer sleeves are coupled together in a telescopingly movable fashion with respect to the base and are configured to surround the pipe. The cap has an opening disposed therein and a channel formed at a periphery of the opening. The channel is configured to receive an end of the pipe. The periphery of the opening is configured to attach to the pipe to secure the cap to the pipe.

Additional features and advantages of the disclosure will become apparent to those skilled in the art upon consideration of the following detailed description of the illustrated embodiment exemplifying the best mode of carrying out the disclosure as presently perceived.

BRIEF DESCRIPTION OF DRAWINGS

The present disclosure will be described hereafter with reference to the attached drawings which are given as non-limiting examples only, in which.

Corresponding reference characters indicate corresponding parts throughout the several views. The exemplification set out herein illustrates embodiments of the pipe boot assembly, and such exemplification is not to be construed as limiting the scope of the pipe boot assembly in any manner.

DETAILED DESCRIPTION OF THE DRAWINGS

Figure 1:
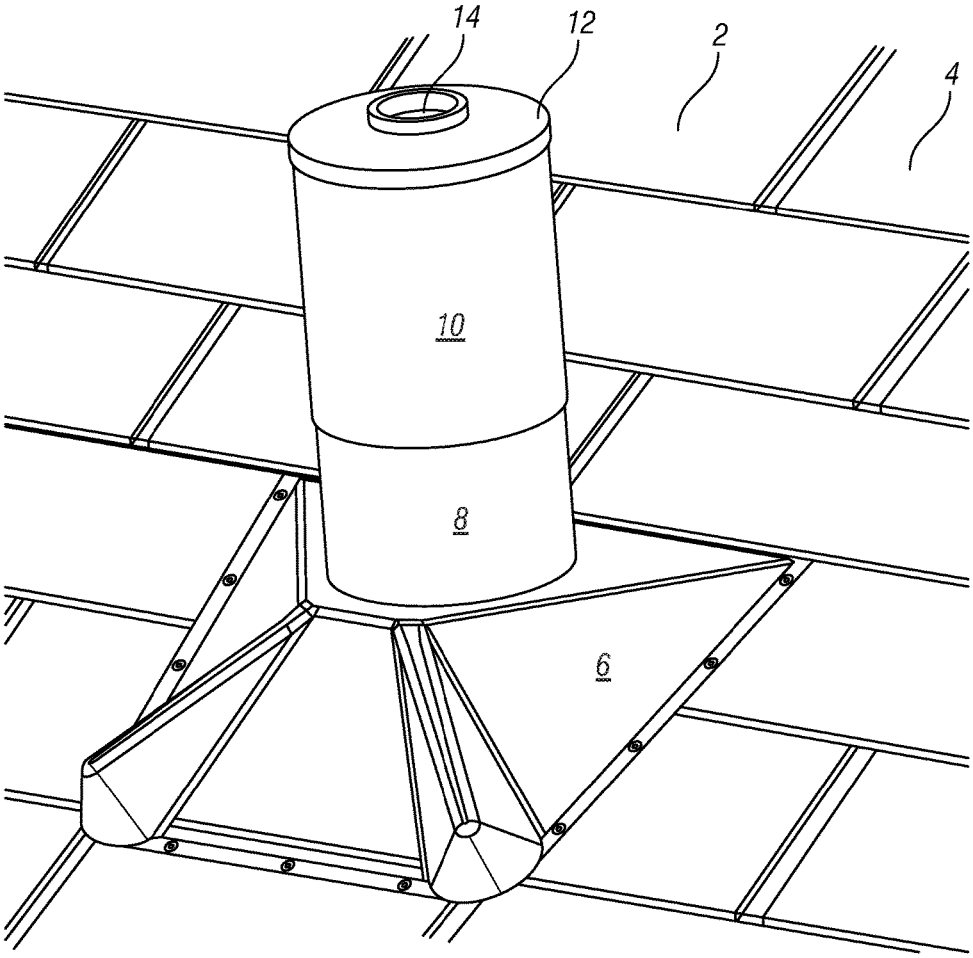
FIG. 1 is a perspective view of a pipe boot assembly attached to a roof of a structure such as a house.

A perspective view of a pipe boot assembly 2 attached to a roof 4 of a building such as a house is shown in FIG. 1.

Pipe boot assembly 2 illustratively comprises a base flashing 6, inner sleeve 8, outer sleeve 10 telescopingly engaged with inner sleeve 8, and an interlocking cap 12 having an opening 14 disposed thereto to accommodate the opening of a shrouded plumbing pipe. As is evident, the telescoping engagement between inner and outer sleeves 8 and 10, respectively, make it possible for pipe boot assembly 2 to shroud pipes that extend various lengths from roof 4.

Figure 2:
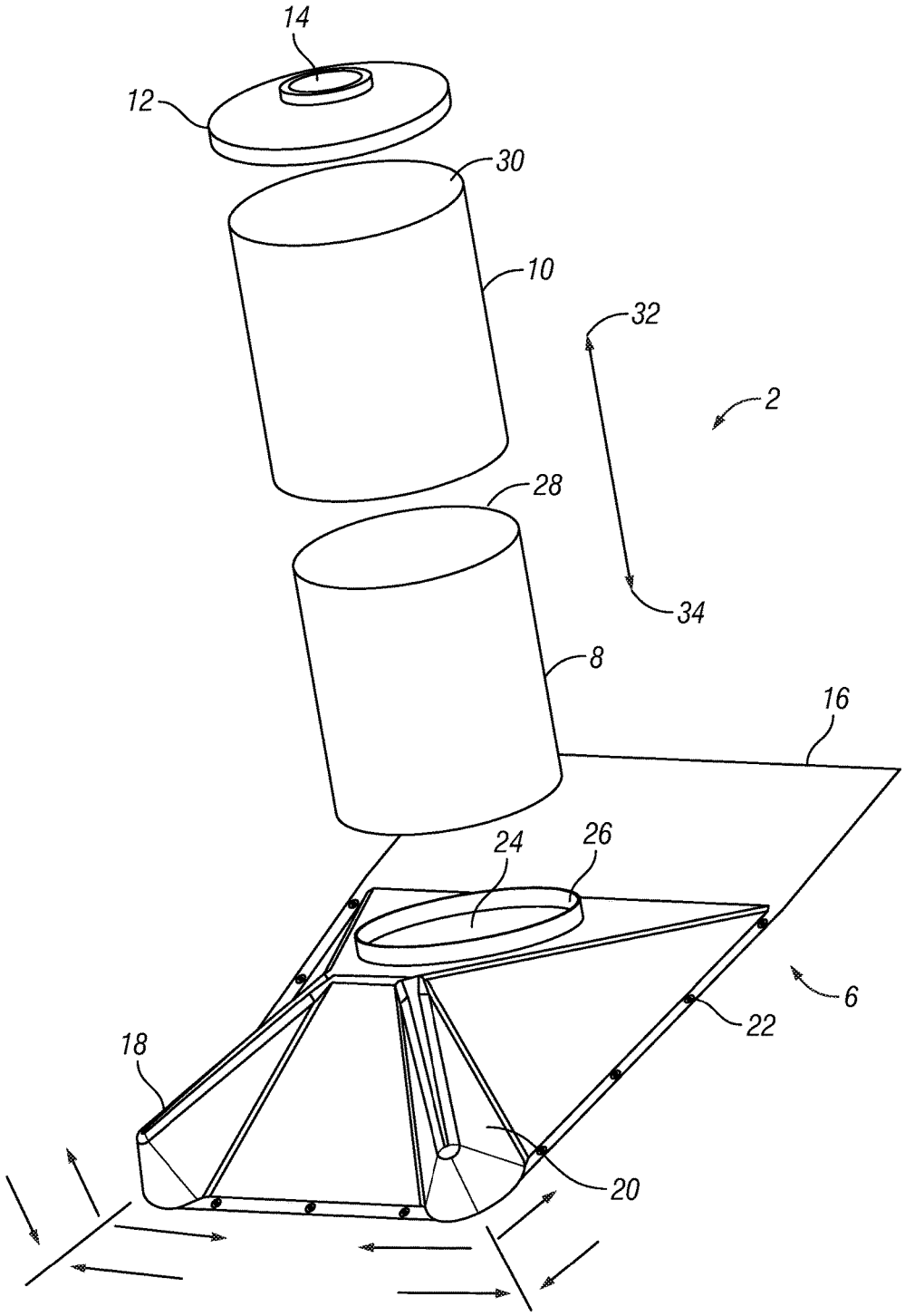
FIG. 2 is an exploded view of the pipe boot assembly of FIG. 1.

An exploded view of pipe boot assembly 2 is shown in FIG. 2. In this view, base flashing 6 includes a back flange 16 configured to fit under shingles of a roof. Front corners 18 and 20 are sloped and bend inward to increase the slope of the pitch pipe flashing. Alternatively, they may be bent outward to decrease the pitch of the pipe flashing. In an illustrative embodiment, raised nail embosses are formed along the periphery of flashing 6 to assist with its install. Opening 24 includes a flange 26 formed around its periphery through which the plumbing pipe may extend. Inner sleeve 8 fits to flange 26. It is appreciated the seal between inner sleeve 8 and flange 26 may be water tight. Outer sleeve 10 fits over inner sleeve 8 in a telescoping manner. Openings 28 and 30 are disposed through sleeves 8 and 10 to form the passageway that receives the extending plumbing pipe. Outer sleeve 10 may be moved in directions 32 and 34 to create the telescoping adjustment to accommodate plumbing pipes of varying heights, as well as account for roof expansion and contraction. Interlocking cap 12 may be configured to attach to outer sleeve 10, as well as fit onto the top of the plumbing pipe to complete the shrouding of same. It is appreciated that despite cap 12 being attached to outer sleeve 10, it is not otherwise affixed to inner sleeve 8 to allow the vertical movement in directions 32 and 34. It is further appreciated that cap 12 and other structures may be made of galvanized steel such as 26 gauge G-90 galvanized steel. The caps may also be made in a variety of sizes to correspond to the standard sizes of PVC or other plumbing pipes.

Figure 3:
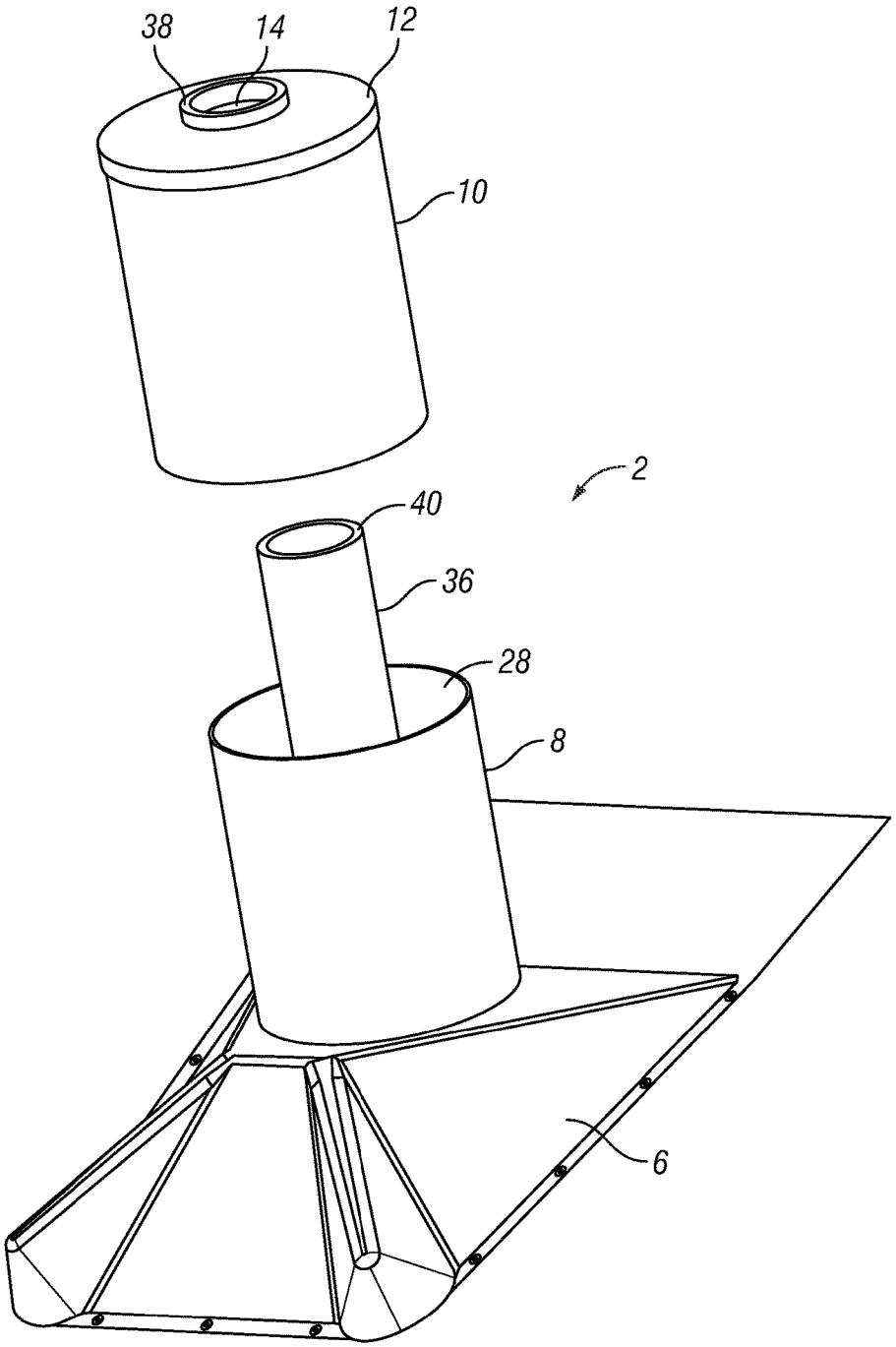
FIG. 3 is a partially exploded view of pipe boot assembly partially assembled on an extending pipe.

A perspective partially exploded view of pipe boot assembly 2 is shown in FIG. 3. This view depicts how PVC plumbing pipe 36 may be disposed through base flashing 6 and inner sleeve 8 through opening 28. Outer sleeve 10 with cap 12 attached thereto may then be placed over plumbing pipe 36 to shroud the same. A pipe seat 38 may be formed about the periphery of opening 14 in cap 12 to receive end 40 of plumbing pipe 36 to support both outer sleeve 10 and cap 12. It is appreciated from this view how by engaging this operation with outer sleeve 10 being placed over inner sleeve 8, plumbing pipe 36 may be any variety of lengths, yet still remain shrouded.

Figure 4:
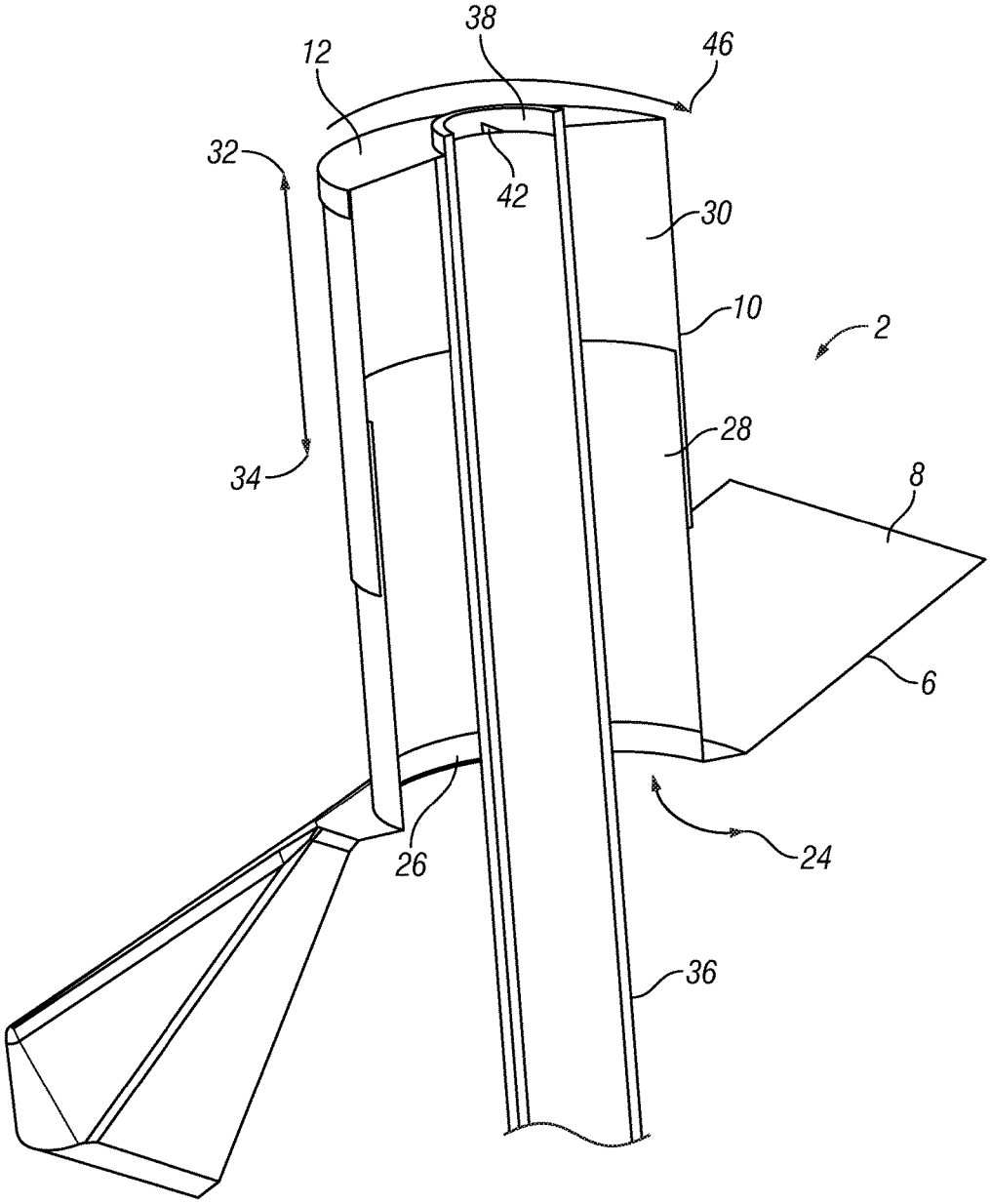
FIG. 4 is a perspective cross-sectional view of the pipe boot assembly attached to a pipe.

A perspective cut away view of pipe boot assembly 2 shrouding plumbing pipe 36 is shown in FIG. 4. This view demonstrates how pipe 36 extends upward through openings 24, 28, and 30 in base 6, inner sleeve 8, and outer sleeve 10, respectively. Flange 26 is also shown attached to inner sleeve 8. This view also depicts how outer sleeve 10 may be placed over inner sleeve 8 and moved in directions 32 and 34 to shroud pipe 36. The overlap between inner and outer sleeves 8 and 10, respectively, offers a variety of heights that pipe boot assembly 2 may shroud. A barb or prong 42 may be formed in or otherwise be part of pipe seat 38 to assist attaching cap 12 to pipe 36. Illustratively, cap 12 may be rotated in direction 46 so that barb or prong 42 may dig into the inside of the pipe to secure the same on to the pipe boot assembly 2. Conversely, to illustratively remove pipe boot assembly 2, cap 12 may be rotated in the opposite direction and then allows outer sleeve 10 with cap 12 may be lifted off.

Figure 5A:
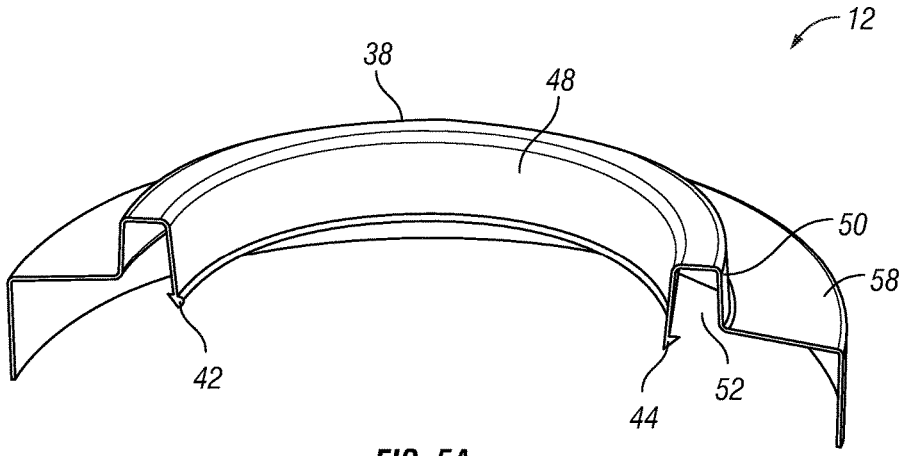
FIGS. 5A and B are perspective and side cross-sectional views of the cap portion of the pipe boot assembly.
Figure 5B:
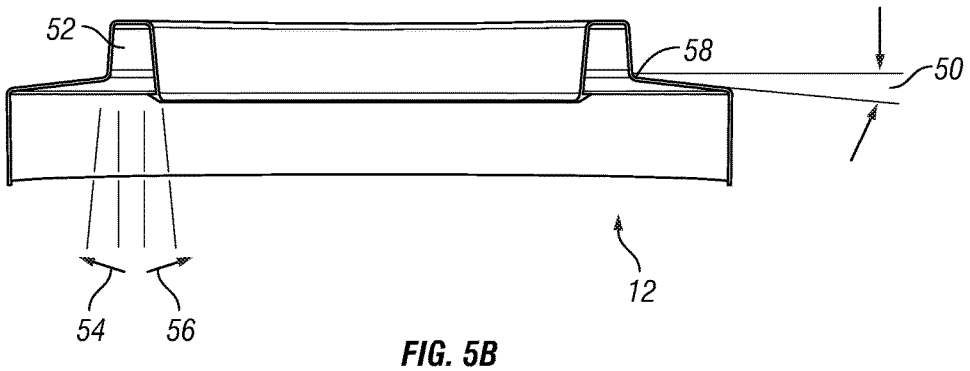
Figure 6A:
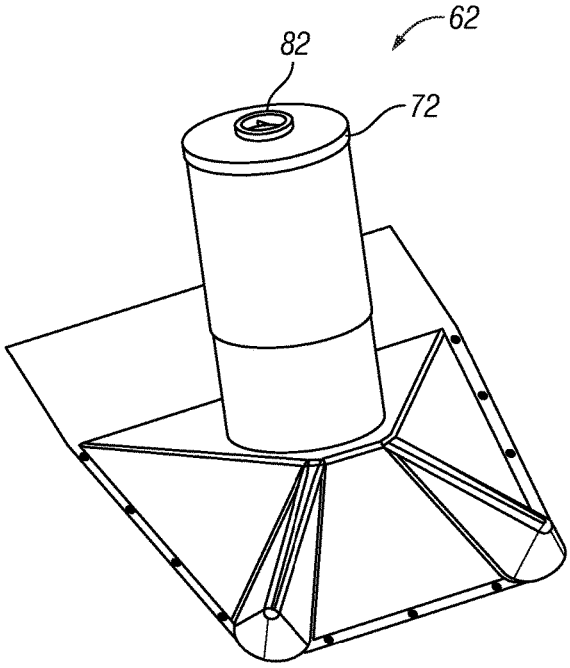
FIGS. 6A through D are perspective views of pipe boot assemblies configured to shroud pipes of varying diameters.
Figure 6B:
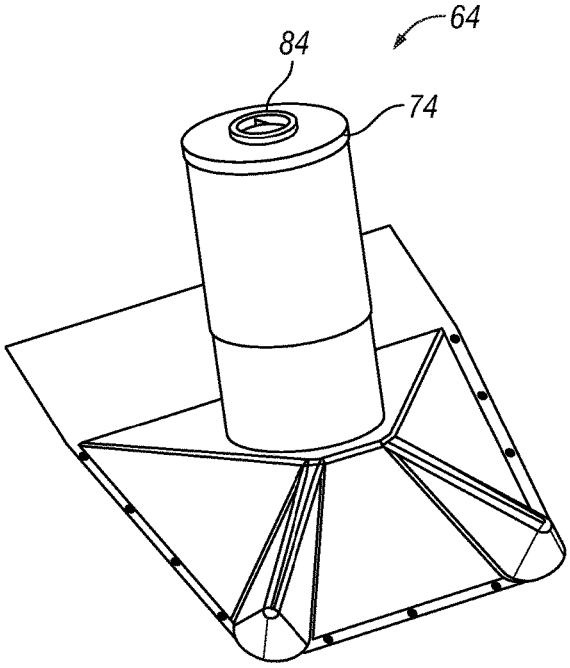
Figure 6C:
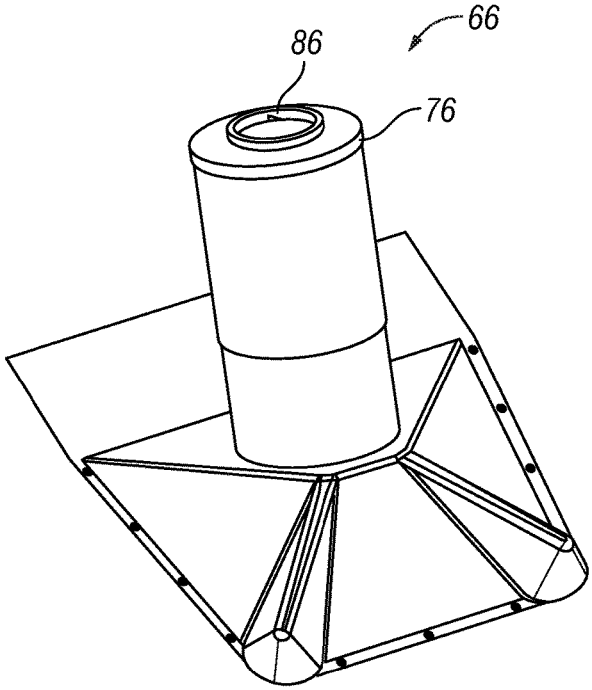
Figure 6D:
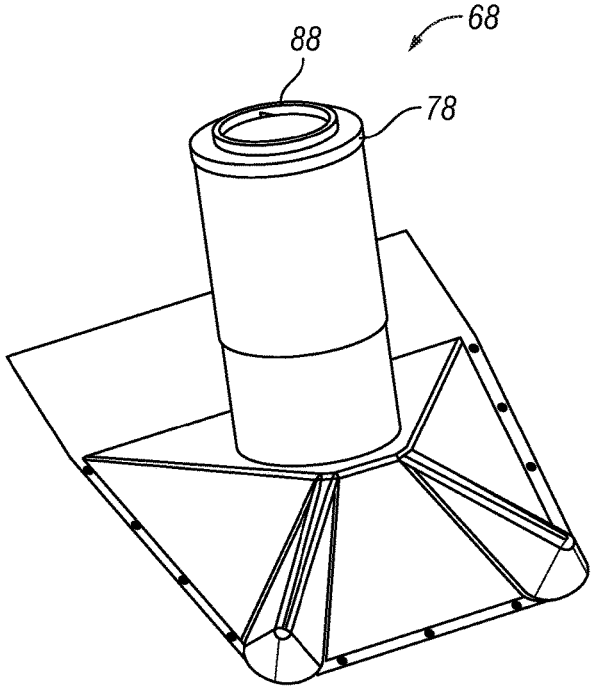

Perspective and elevational cross-sectional views of inter locking cap 12 is shown in FIGS. 5A and B. Prongs 42 and 44 are shown extending outwardly from inner wall 48 of pipe seat 38. Between inner wall 48 and outer wall 50, a channel 52 is formed that receives the end 40 of pipe 36. Prongs 42 and 44 extend into channel 52 so as to cut a groove or thread into the wall of pipe 36 to secure cap 12 thereto. This attachment means is like forming a thread, similar to threads on a fastener threading a hole. Cap 12 may be rotated in a first direction to attach to pipe 36, and then rotated in the opposite direction to attach from pipe 36. In addition to the prongs, inner and outer sidewalls 48 and 50 taper away from the center of channel 52 in order to help with pipe alignment and the channel. Tapers 54 and 56 are illustratively 5 degree tapers on each side to help guide pipe end 40 into channel 52. In addition, top surface 58 of cap 12 is sloped downward for water drainage. The slope may illustratively be about 6 degrees, as indicated by reference numeral 60 in FIG. 5B.

FIGS. 6 through 10 demonstrate how the pipe boot assembly can be sized to accommodate plumbing pipes of varying diameters. Typically, these plumbing pipes have standard sizes such as 1½, 2, 3, and 4 inches. As shown in FIG. 6A through D, a plurality of pipe boot assemblies—62, 64, 66, and 68 are shown. The principal distinction is in their caps 72, 74, 76, 78, respectively. As shown in FIG. 6A, cap 72 has a pipe seat 82 configured to accommodate an illustrative 1½ inch diameter pipe. Similarly, cap 74 includes pipe seat 84 sized to accommodate a 2 inch pipe; pipe seat 86 of cap 76 accommodates a 3 inch pipe; and lastly seat 88 of cap 78 is sized to receive a 4 inch pipe. It is appreciated that the telescoping sleeve, such as 8 and 10 previously discussed, may be used with any of these caps. In addition, these caps may be made of 26 gauge G-90 galvanized steel.

Figure 7A:
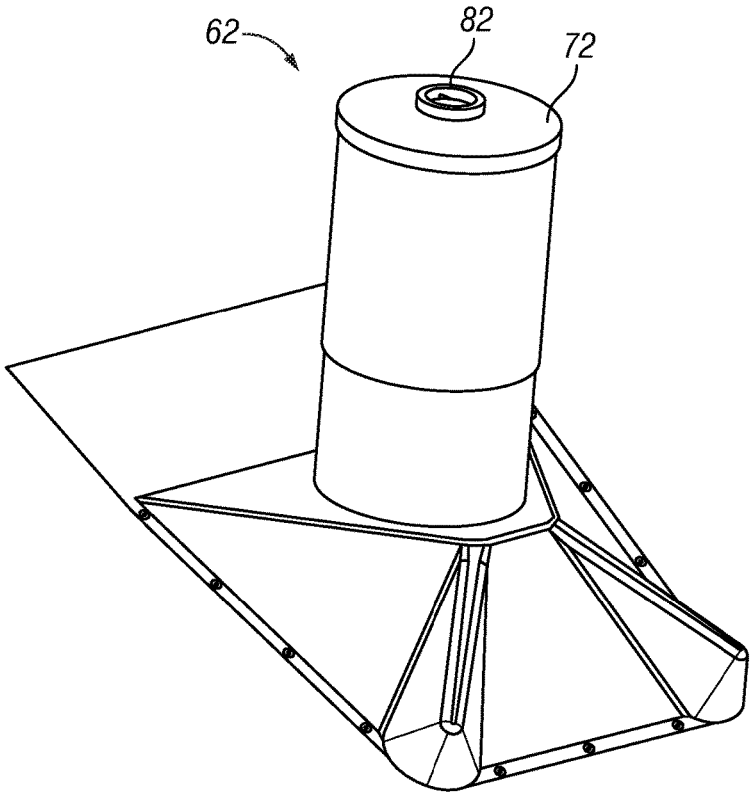
FIGS. 7A and B are perspective and cross-sectional perspective views of a pipe boot assembly configured to shroud a pipe having a diameter of about 1½ inches.
Figure 7B:
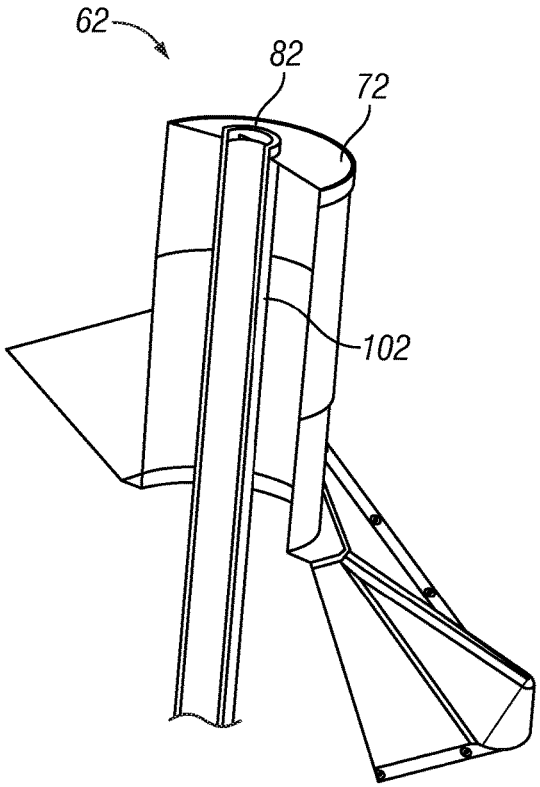
Figure 8A:
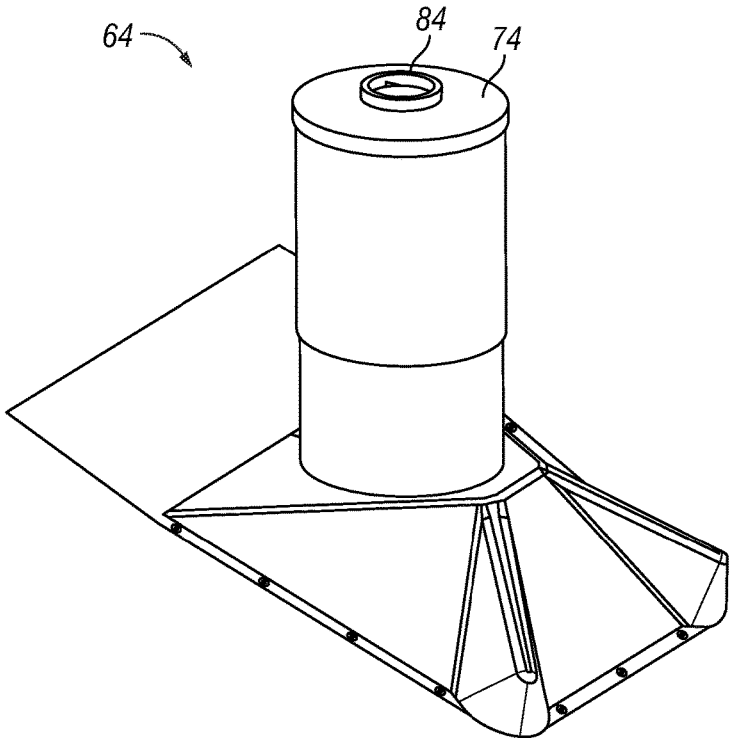
FIGS. 8A and B are perspective and cross-sectional perspective views of a pipe boot assembly configured to shroud a pipe having a diameter of about 2 inches.
Figure 8B:
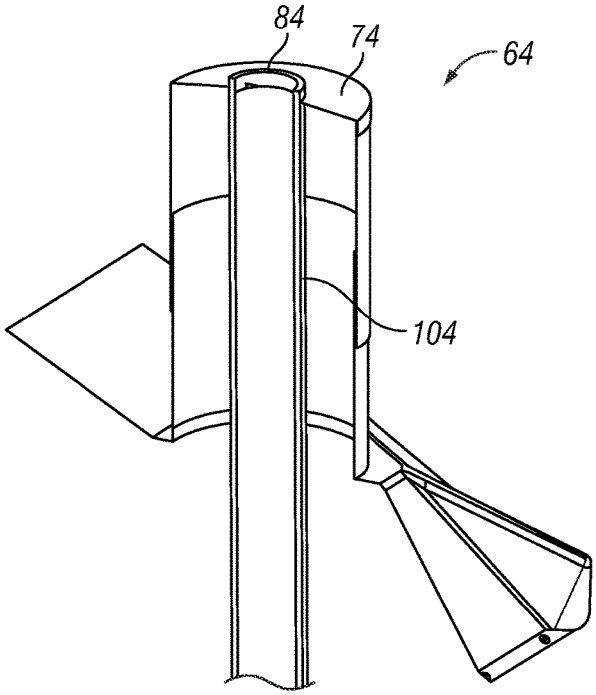
Figure 9A:
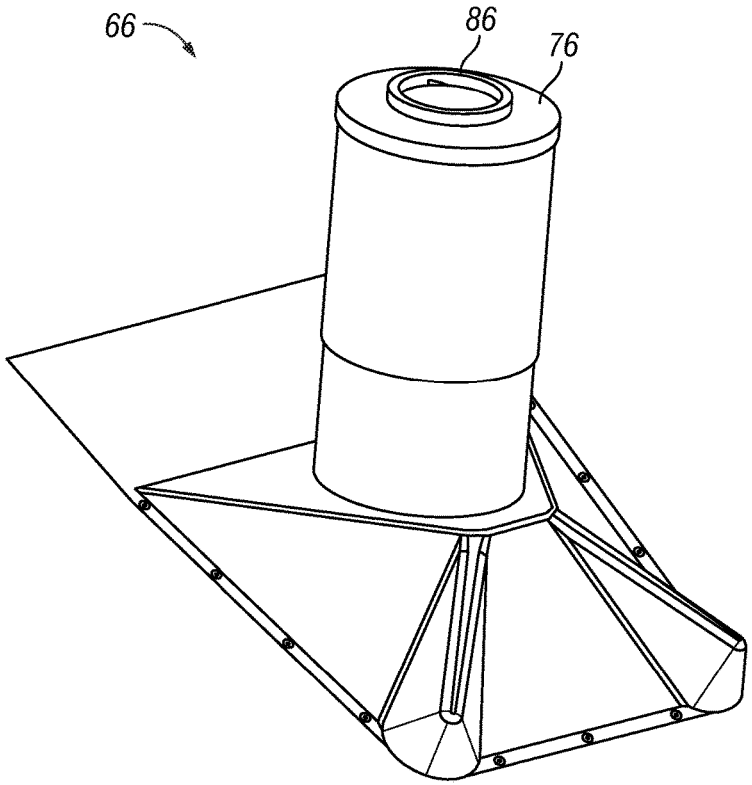
FIGS. 9A and B are perspective and cross-sectional perspective views of a pipe boot assembly configured to shroud a pipe having a diameter of about 3 inches.
Figure 9B:
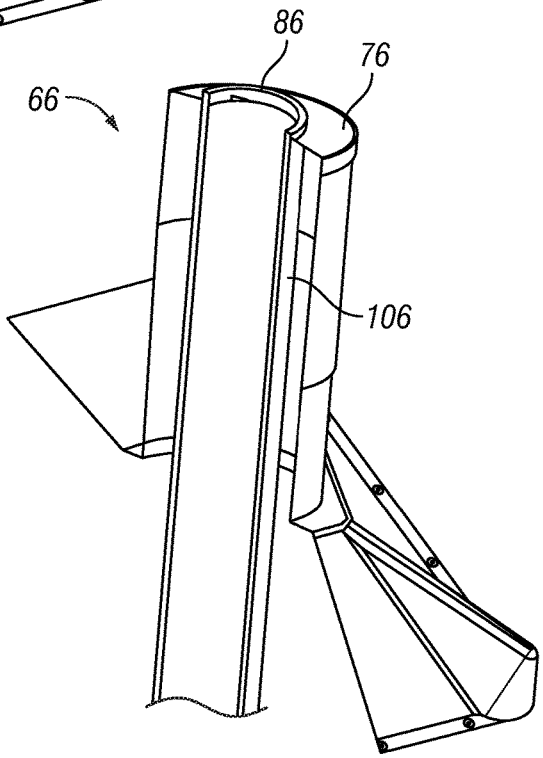
Figure 10A:
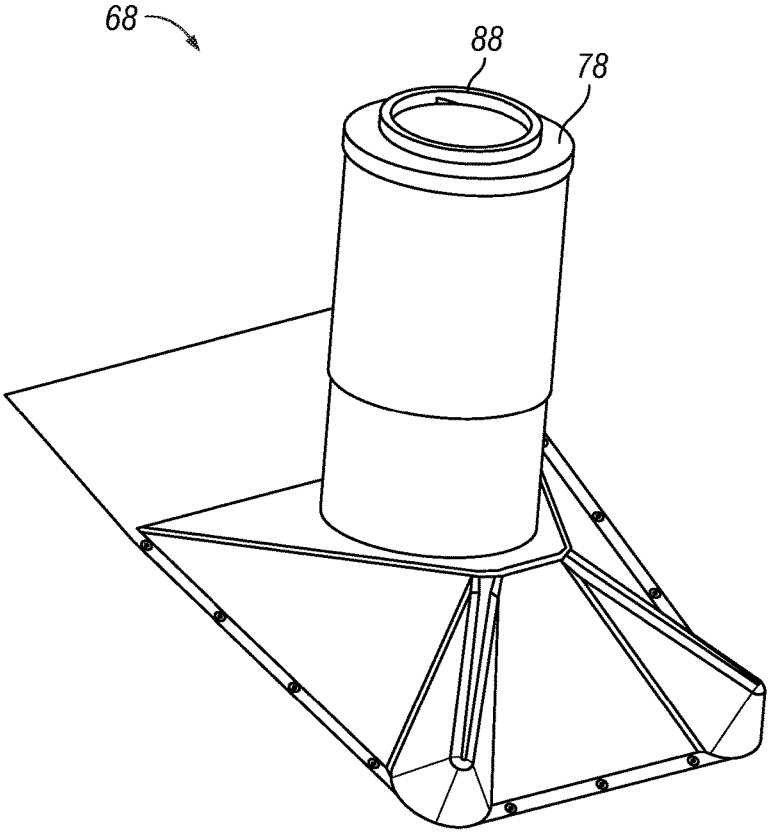
FIGS. 10A and B are perspective and cross-sectional perspective views of a pipe boot assembly configured to shroud a pipe having a diameter of about 4 inches.
Figure 10B:
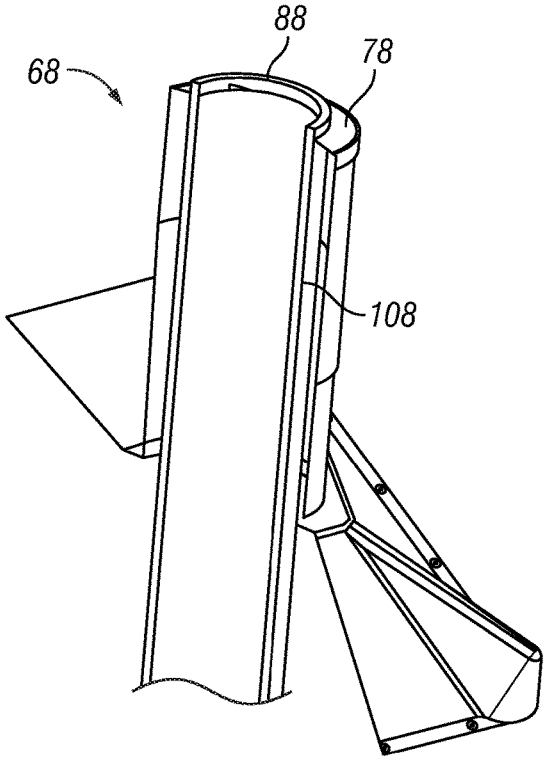

Pipe boot assembly 62 shown in FIGS. 7A and B demonstrates how a 1½ inch diameter pipe 102 may fit into seat 82 of cap 72. In similar fashion, pipe boot assembly 64 shown in FIGS. 8A and B demonstrate how pipe 104 is seated in seat 84 in cap 74. The views in FIGS. 9A and B include pipe boot assembly 66 which show how pipe 106 fits into seat 86 of cap 76. And lastly, pipe boot assembly 68 shown in FIGS. 10A and B demonstrates how pipe 108 fits into seat 88 of cap 78. It is appreciated that these pipe boot assemblies shown in FIGS. 6 through 10 may include the same prongs as those described in the first embodiment and can be assembled and disassembled in the same manner as discussed as well.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A pipe boot assembly comprising:

a base configured to attach to a roof;

wherein the base is configured to be located about a pipe that extends from the roof;

inner and outer sleeves coupled together in a telescopingly movable fashion with respect to the base, and configured to surround the pipe; and a cap;

wherein the cap has an opening disposed therein and a channel formed at a periphery of the opening;

wherein the channel is configured to receive an end of the pipe; and wherein the periphery of the opening includes a prong that forms a groove into a sidewall of the pipe such that at least a portion of the prong is positioned in the groove to secure the cap to the pipe.

2. The pipe boot assembly of claim 1, wherein the prong is a first prong, and wherein the periphery of the opening includes the first prong spaced apart from a second prong; wherein the second prong forms a second groove into the sidewall of the pipe such that at least a portion of the second prong is positioned in the second groove, and each said prong secures the cap to the pipe.

3. A pipe boot assembly comprising:

a base configured to attach to a roof;

wherein the base is configured to be located about a pipe that extends from the roof;

a first sleeve;

wherein the first sleeve is attached to the base;

wherein the first sleeve is configured to be located about the pipe;

a second sleeve;

wherein the second sleeve is movable with respect to the first sleeve;

wherein the second sleeve is configured to be located about the pipe; and a cap;

wherein the cap is attached to the second sleeve;

wherein the cap has an opening disposed therein configured to engage an end of the pipe; and wherein a periphery of the opening disposed in the cap includes a barb that couples the cap to the pipe;

wherein the barb has a tip that cuts a groove into a sidewall of the pipe; and wherein at least a portion of the barb is positioned in the groove to secure the cap to the pipe.

4. The pipe boot assembly of claim 3, wherein the barb is a first barb, and wherein the periphery of the opening disposed in the cap includes a second barb spaced apart from the first barb, and also couples the cap to the pipe; wherein the second barb has a second tip that cuts a second groove into the sidewall of the pipe to secure the cap to the pipe.

5. The pipe boot assembly of claim 3, wherein the first sleeve is an inner sleeve.

6. The pipe boot assembly of claim 3, wherein the second sleeve is an outer sleeve.

7. The pipe boot assembly of claim 3, wherein the first sleeve is located at least partially in the second sleeve; and wherein the second sleeve is movable in a telescoping manner with respect to the first sleeve.

8. The pipe boot assembly of claim 3, wherein the base is a base flashing having at least one corner bent.

9. The pipe boot assembly of claim 3, wherein the base, inner and outer sleeves each includes an opening to receive the pipe.

10. A pipe boot assembly comprising:

a base configured to attach to a roof;

wherein the base is configured to be located about a pipe that extends from the roof;

a first sleeve;

wherein the first sleeve is attached to the base;

wherein the first sleeve is configured to be located about the pipe;

a second sleeve;

wherein the second sleeve is movable with respect to the first sleeve;

wherein the second sleeve is configured to be located about the pipe; and a cap;

wherein the cap is attached to the second sleeve;

wherein the cap has an opening disposed therein and a channel formed at a periphery of the opening;

wherein the channel is configured to receive an end of the pipe; and wherein the periphery of the opening includes a barb that forms a groove in the pipe such that at least a portion of the barb is positioned in the groove to secure the cap to the pipe.

11. The pipe boot assembly of claim 10, wherein the barb forms the groove in the pipe by rotational movement of the cap with respect to the pipe.

12. The pipe boot assembly of claim 10, wherein the first sleeve is an inner sleeve.

13. The pipe boot assembly of claim 10, wherein the second sleeve is an outer sleeve.

14. The pipe boot assembly of claim 10, wherein the first sleeve is located at least partially in the second sleeve; and wherein the second sleeve is movable in a telescoping manner with respect to the first sleeve.

15. The pipe boot assembly of claim 10, wherein the base is a base flashing having at least one corner bent.

16. The pipe boot assembly of claim 10, wherein the base, inner and outer sleeves each includes an opening to receive the pipe.

17. The pipe boot assembly of claim 10, wherein the barb is a first barb, and wherein the periphery of the opening includes a second barb spaced apart from the first barb, and also couples the cap to the pipe; wherein the second barb has a second tip that forms a second groove into a sidewall of the pipe to secure the cap to the pipe.

18. The pipe boot assembly of claim 17, wherein both the first barb and the second barb are directed toward the channel.

* * * * *